US012800142B2

(12) United States Patent
Kreis et al.

(10) Patent No.: US 12,800,142 B2
(45) Date of Patent: Nov. 17, 2026

(54) INFRARED RADIANT HEATER

(71) Applicant: Schwank GmbH, Cologne (DE)

(72) Inventors: Edgar Kreis, Freigericht (DE); Alexander Genzel, Bonn (DE); Torsten Stohler, Mettmann (DE); Thomas Renner, Wesseling (DE)

(73) Assignee: Schwank GmbH, Cologne (DE)

( * ) Notice: Subject to any disclaimer, the term of this patent is extended or adjusted under 35 U.S.C. 154(b) by 386 days.

(21) Appl. No.: 18/691,103

(22) PCT Filed: Dec. 6, 2022

(86) PCT No.: PCT/EP2022/084656
§ 371 (c)(1),
(2) Date: Mar. 12, 2024

(87) PCT Pub. No.: WO2023/104825
PCT Pub. Date: Jun. 15, 2023

(65) Prior Publication Data

US 2024/0410571 A1 Dec. 12, 2024

(30) Foreign Application Priority Data

Dec. 10, 2021 (EP) ..... 21213746

(51) Int. Cl.
*F23D 14/14* (2006.01)

(52) U.S. Cl.
CPC ..... *F23D 14/145* (2013.01); *F23D 2208/10* (2013.01)

(58) Field of Classification Search
CPC .. F23D 14/145; F23D 14/12; F23D 2203/002; F23D 2203/005; F23N 5/082
See application file for complete search history.

(56) References Cited

U.S. PATENT DOCUMENTS

| | | | | |
|---|---|---|---|---|
| 5,046,944 A | | 9/1991 | Smith | |
| 5,487,266 A | * | 1/1996 | Brown | F01D 21/003 60/776 |
| 5,511,971 A | * | 4/1996 | Benz | F23N 5/003 431/9 |
| 6,024,083 A | * | 2/2000 | Smirnov | F23D 14/24 126/91 A |
| 6,045,353 A | * | 4/2000 | VonDrasek | F23N 5/082 431/12 |

(Continued)

FOREIGN PATENT DOCUMENTS

| | | |
|---|---|---|
| DE | 10 2014 019 765 A1 | 1/2016 |
| EP | 2 014 980 A1 | 1/2009 |
| EP | 2 708 814 A1 | 3/2014 |

OTHER PUBLICATIONS

International Search Report in PCT/EP2022/084656, mailed Mar. 27, 2023.

*Primary Examiner* — Ko-Wei Lin
(74) *Attorney, Agent, or Firm* — Collard & Roe, P.C.

(57) ABSTRACT

An infrared radiant heater, in particular a dark radiant heater or a bright radiant heater, includes a burner and a fan. The burner is connected to a combustion gas supply and the fan is designed to supply the burner with combustion air. The combustion gas supply is connected to a hydrogen source as a combustion gas source. A UV sensor is provided which is designed to detect at least one parameter of the flame generated by the burner.

10 Claims, 1 Drawing Sheet

(56) References Cited

U.S. PATENT DOCUMENTS

Figure 1:
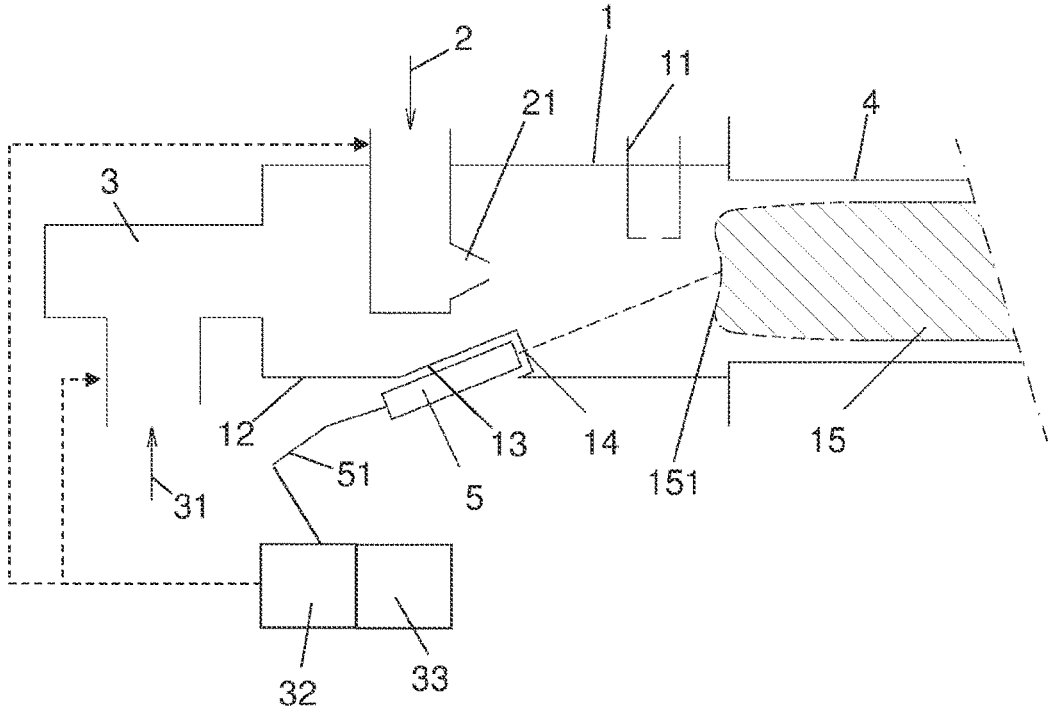

| | | | | |
|---|---|---|---|---|
| 2008/0076080 | A1* | 3/2008 | Hu | F01K 23/105 73/23.31 |
| 2009/0029306 | A1 | 1/2009 | Schwank | |
| 2014/0076307 | A1 | 3/2014 | Boehm | |
| 2015/0101591 | A1* | 4/2015 | Gulkanat | F23D 14/145 126/39 J |
| 2015/0276220 | A1* | 10/2015 | Karkow | F23L 7/007 110/297 |
| 2015/0338090 | A1* | 11/2015 | Song | F24C 15/001 431/329 |
| 2016/0245509 | A1* | 8/2016 | Karkow | F23G 7/08 |
| 2017/0051913 | A1* | 2/2017 | Colannino | F23C 9/08 |
| 2018/0038588 | A1* | 2/2018 | Karkow | F23C 5/02 |
| 2020/0408403 | A1* | 12/2020 | Rush, III | F23D 14/16 |
| 2022/0042682 | A1* | 2/2022 | Suzuki | F23N 5/242 |

* cited by examiner

INFRARED RADIANT HEATER

CROSS REFERENCE TO RELATED APPLICATIONS

This application is the National Stage of PCT/EP2022/084656 filed on Dec. 6, 2022, which claims priority under 35 U.S.C. § 119 of European Application No. 21213746.7 filed on Dec. 10, 2021, the disclosure of which is incorporated by reference. The international application under PCT article 21 (2) was not published in English.

The invention relates to an infrared radiant heater, in particular a dark radiant heater or a bright radiant heater, having a burner and a fan, wherein the burner is connected to a fuel gas supply, wherein the fan is set up for supplying combustion air to the burner.

In the commercial and industrial sector, infrared radiant heaters are frequently used for heating production and warehousing sites. These radiant heaters are installed, in particular, on the ceiling or on the wall, and serve for heating tall spaces or only moderately insulated spaces. Infrared radiant heaters are characterized in that the irradiated surfaces are primarily heated by means of the infrared radiation. As a result, they give off their heat almost without any loss. In this regard, draft air phenomena, such as they occur in the case of conventional combustion systems, are avoided. To increase the degree of effectiveness of infrared radiant heaters, reflectors are frequently used.

In the sector of infrared radiant heaters, a distinction is made between bright radiant heaters and dark radiant heaters. In the case of bright radiant heaters, a fuel gas/air mixture is combusted at the surface of one or more ceramic radiant panels provided for this purpose. Either natural gas or liquefied gas (propane gas or biogas) is used as the fuel gas. The name bright radiant heater is based on the visible combustion of the fuel gas/air mixture on the ceramic radiant panel, which glows as a result. For this purpose, the ceramic radiant panel has flame pass-through channels arranged parallel to one another, having depressions, frequently conical depressions, affixed toward the emission side. During combustion, the flame formation occurs essentially in the depressions, and thereby uniform heating of the side walls of the depressions and of the ridges formed between the depressions takes place. Such bright radiant heaters are described, for example, in EP 2 014 980 A1.

Dark radiant heaters have one or more radiant tubes as radiating elements, to which at least one burner is assigned. By means of combustion of a mixture of fuel gas and air within the burner, a flame is generated, which can be distributed over the entire length of the radiant tube, using a fan. Likewise, either natural gas or liquefied gas (propane gas or biogas) is used as the fuel gas. The radiant tubes are regularly connected to be continuous and linear or U-shaped subsequent to the burner, and are supposed to emit the heat generated by the flame uniformly over the entire tube progression. The radiant tube is uniformly heated by the flame and by the hot gases produced thereby, and generates a heat radiation that is emitted to a region to be heated. The exhaust gases that result from combustion are removed from the radiant tube using the fan, for example they are conducted away to the outside air by way of exhaust gas tubes. Such dark radiant heaters are described, for example, in EP 2 708 814 A1.

In order to prevent an undesired discharge of gas in the case of such gas-operated infrared radiant heaters, it is necessary to monitor the flame of the gas combustion. Monitoring of the flame usually takes place by means of ionization electrodes, such as described, for example, in DE 10 2014 019 765 A1. Ionization electrodes make use of the rectifier effect of a flame for detecting the presence of combustion. In this regard, alternating current applied to the ionization electrode is converted to direct current when a flame is present. A disadvantage of this method of flame monitoring is that the ionization electrode must penetrate into the gas flame, and therefore its useful lifetime is restricted. In this regard, the durability of the ionization electrode depends, in particular, on the temperature of the combustion. The higher the temperature of the fuel gas, the lower the useful service life of the required ionization electrode.

This is where the invention seeks to provide a remedy. The invention is based on the task of making available an infrared radiant heater that allows reliable and low-maintenance flame monitoring even in the case of combustion gases having a high combustion temperature, in particular hydrogen. According to the invention, this task is accomplished by means of the characteristics of the characterizing part of claim 1.

With the invention, an infrared radiant heater is made available that allows reliable and low-maintenance flame monitoring. Because of the fact that the fuel gas supply is connected to a hydrogen source as the fuel gas source, wherein a UV sensor is provided, which is set up to detect at least one parameter of the flame generated by the burner, low-maintenance flame monitoring is made possible even at the high flame temperature of the fuel gas. The UV sensor used for flame monitoring has no contact with the flame and is therefore not subject to any heat-related wear.

By means of the use of hydrogen as the fuel gas, a reduced emission of harmful substances is achieved. Since hydrogen does not contain any carbon, theoretically no carbonaceous pollutants such as carbon monoxide, carbon dioxide or hydrocarbons are contained in the exhaust gas. Surprisingly it was found that reliable monitoring of the invisible hydrogen flame is made possible by means of the UV sensor.

In a further development of the invention, the infrared radiant heater is a dark radiant heater that comprises a radiant tube in which the burner is arranged, wherein the UV sensor is directed at the base of the flame. It is advantageous if the radiant tube is connected to a viewing window, wherein the UV sensor is directed at the base of the flame from outside of the radiant tube, through the viewing window. In this way, impairment of the UV sensor by the flame heat is further prevented.

In an embodiment of the invention, the radiant tube is connected to an exhaust gas discharge line, wherein a combustion air mixing chamber precedes the burner in the flame direction, which chamber is connected to a combustion air source and the exhaust gas discharge line. By means of supplying exhaust gases to the combustion air, oxygen reduction is achieved, and thereby a reduction in the flame temperature is made possible. Furthermore, a reduction in nitrogen oxide emission is brought about by the recirculation of the exhaust gas.

In a further embodiment of the invention, the fan is arranged to precede the burner in the flame direction, and the combustion air mixing chamber is arranged within the fan. In this way, good mixing of combustion air and exhaust gas within the fan is achieved.

In a further development of the invention, an adjustment device is arranged on the discharge line, by means of which device the ratio of the exhaust gas volume stream of the exhaust gas discharge line to the combustion air volume stream of the combustion air source can be set. In this way, it is possible to adjust the oxygen content of the combustion air/exhaust gas mixture.

In a further embodiment of the invention, the infrared radiant heater is a bright radiant heater that has a radiant panel provided with flame passage channels, which serves as a radiating surface, wherein the burner is set up to bring about glowing of the radiating panel over its full area, and wherein the UV sensor is directed at the radiant panel so as to enclose an obtuse angle with it. In this way, reliable flame detection is achieved.

In an embodiment of the invention, a reflector that encloses the radiant panel, at least in certain regions, is provided, which reflector is provided with a window, wherein the optical sensor is directed at the radiant panel from outside of the reflector, through the window. In this way, flame detection in a position of the sensor that is protected from the flame heat is achieved.

In a further embodiment of the invention, the reflector encloses the emission surface of the radiant panel and delimits an exhaust gas space, wherein a combustion air mixing space is arranged ahead of the burner, which space is connected to a combustion air source and the exhaust gas space. Oxygen reduction is achieved by means of the supply of exhaust gases to the combustion air, and thereby a reduction in the flame temperature is made possible. Furthermore, a reduction in nitrogen oxide emission is brought about by means of the recirculation of the exhaust gas.

In a further embodiment of the invention, the exhaust gas space is connected to the combustion air mixing space by way of an ejector, wherein the driving medium of the ejector is combustion air introduced by means of the fan, and the medium drawn into the combustion air mixing space is exhaust gas situated in the exhaust gas space. In this way, a defined ratio of combustion air and exhaust gas is achieved. Preferably, an adjustment apparatus is provided, by way of which the ratio of the combustion air volume stream and the exhaust gas volume stream of the ejector that is drawn in can be adjusted.

In a further development of the invention, the UV sensor is connected to a setting device connected to the fuel gas supply, to interrupt and/or to set the hydrogen supply. In this way, an interruption of the hydrogen supply is possible if the flame is extinguished, and thereby an undesired exit of hydrogen is counteracted.

In an embodiment of the invention, the UV sensor is set up for UV resonance absorption spectroscopy. In this way, detection of the NOX content of the flame and of the combustion exhaust gas that surrounds it is made possible.

In a further embodiment of the invention, the setting device and/or the adjustment device is/are connected to a control and regulation module, which is programmed to regulate the flame properties by means of a comparison of the actual parameter transmitted by the UV sensor with stored reference parameters, by means of changing the hydrogen volume stream and/or the combustion air volume stream and/or the ratio of exhaust gas stream and combustion air stream.

It is advantageous if the actual parameter is a NOX value detected by the UV sensor, wherein the control and regulation module is programmed to regulate the flame temperature on the basis of the difference between the actual value and a stored reference value, by means of changing the hydrogen volume stream and/or the combustion air volume stream and/or the ratio of exhaust gas stream and combustion air stream. In this way, temperature regulation of the flame is made possible by way of control of this mixture ratio, by way of a NOX reference value default. A change in the flame temperature has a direction effect on the NOX value of the exhaust gas of the flame in a range above 1000°.

Figure 2:
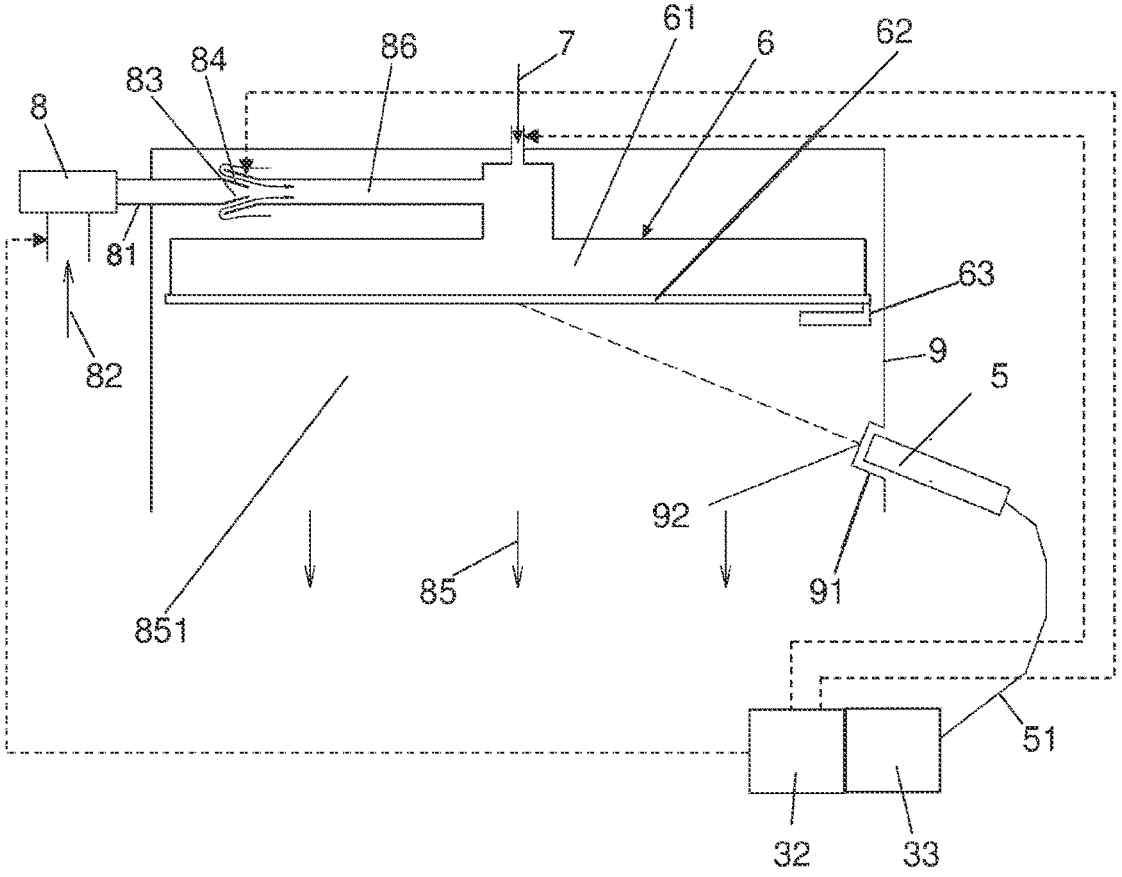

Other further developments and embodiments of the invention are indicated in the other dependent claims. Exemplary embodiments of the invention are shown in the drawings and will be described in detail below. The figures show:

FIG. 1 the schematic representation of an infrared radiant heater in the form of a dark radiant heater, and FIG. 2 the schematic representation of an infrared radiant heater in the form of a bright radiant heater.

The dark radiant heater according to FIG. 1, chosen as an exemplary embodiment, comprises a burner 1 that is connected to a fan 3 and followed by a radiant tube 4. The radiant tube 4 is merely indicated in FIG. 1; the radiant tube 4 can certainly extend over a length of several meters and can be formed from multiple radiant tube elements. In the exemplary embodiment, the radiant tube 4 is configured as a highly heat-resistant stainless steel tube. Alternatively, special steels with a thermally applied aluminum oxide layer can also be used. In the exemplary embodiment, the radiant tube 4 is enclosed by a reflector—not shown—which is formed from surface-structured sheet aluminum in the exemplary embodiment, and which has bulkhead plates on both sides, for the reduction of convective losses.

The burner 1 comprises a gas jet 21 that is connected to a hydrogen supply 2. An ignition electrode 11 is arranged in the burner 1, at a distance from the gas jet 21. On its side of the burner 1 facing away from the ignition electrode 11, the fan 3 is set in such a way that is flushes the gas jet 21 with combustion air. For this purpose, the fan 3 is connected, on the suction side, to a combustion air supply 31.

The hydrogen stream, which exits from the gas jet 21 under pressure, mixes with the combustion air stream, which flushes the gas jet 21, and is ignited when the required mixture ratio is reached, by means of the ignition electrode 11 arranged at a distance from the gas jet 21, and thereby a flame 15 is formed at a distance from the gas jet 21, which flame extends into the radiant tube 4, over its length. In the region 22 of the hydrogen stream that is not capable of ignition, which does not have a sufficient mixture ratio with combustion air, no flame formation takes place.

A sensor holder 13 is introduced into the housing 12 of the burner 1, which holder has a window 14. A UV sensor 5 is introduced into the sensor holder 13, which sensor is connected to a setting device 32 for interrupting the hydrogen supply 2, by way of an electrical line 51. In the exemplary embodiment, the UV sensor 5 is directed centered on the flame base 151 of the flame 15. If no flame 15 is detected by the UV sensor 5, the hydrogen supply is interrupted by the setting device 32.

The control and regulation module 33, in the present case a setting valve, which is connected to the setting device 32, is additionally connected to the ignition electrode 11 here, and set up in such a manner that in the event that no flame is detected, first the ignition electrode 11 is activated, and only after there continues to be no flame, an interruption of the hydrogen supply takes place.

In an optional expansion, the fan 3 can be connected, on its suction side, to an ejector, the drive connector of which is connected to a combustion air supply 31, and the suction connector of which is connected to an exhaust gas supply, which is supplied by an exhaust gas line, which is connected to the radiant tube 4 on the exhaust gas side. The combustion air drawn in by the fan 3 serves as a driving medium here, by means of which intake of the exhaust gas is brought about. On the pressure side, in this way an exhaust gas/ combustion air mixture is supplied to the gas jet 21, by means of the fan 3, which mixture flushes the gas jet 21. The exhaust gas/combustion air mixture has a reduced oxygen content, and thereby a flame having a reduced temperature is brought about. On the basis of the great reactivity of hydrogen, even a low oxygen content in the exhaust gas/combustion air mixture is sufficient for ignition, and thereby a flame 15 that extends through the radiant tube 4 is produced. By means of an adjustment device arranged in the exhaust gas line or in the ejector, for example an adjustment shutter or a setting valve, it is possible to set the mixture ratio of exhaust gas volume stream and combustion air volume stream.

In the exemplary embodiment, the UV sensor 5 is set up for NOX measurement by means of UV resonance absorption spectroscopy, and is connected to the control and regulation module 33. In this regard, the control and regulation module 33 is programmed in such a manner that the actual NOX value delivered by the UV sensor 5 is compared to a stored reference value, and based on the difference of the two values, the flame properties are regulated by means of changing the hydrogen volume stream and/or the combustion air volume stream. For this purpose, the control and regulation module 33 is connected to the setting device 32, by way of which the hydrogen volume stream and the combustion air volume stream can be set. If the fan 3 is provided with the ejector described above, then the programming can additionally undertake regulation of the flame properties by way of an adjustment of the ratio of exhaust gas stream and combustion air stream. For this purpose, the adjustment device is connected to the control and regulation module 33. The setting device 32 and the control and regulation module 33 are merely indicated schematically in the figures, and connected to the points of action with broken lines.

If the fan 3 according to the exemplary embodiment according to FIG. 2 is connected to an ejector on the suction side, by way of which ejector mixing an exhaust gas stream into the combustion air stream takes place, then the ejector or the exhaust gas supply line that supplies it on the suction side can be provided with an adjustment device, by way of which the mixture ratio of exhaust gas stream and combustion air stream can be set. If the UV sensor is set up for UV resonance absorption spectroscopy, regulation of the flame temperature on the basis of a NOX content detected by the UV sensor is possible. For this purpose, it is practical if the sensor is connected to a regulation module, the reference value of which is a predetermined reference NOX value, wherein the actual NOX value is supplied by the UV sensor. On the basis of the difference between the reference value and the actual value, adjustment of the mixture ratio of exhaust gas stream and combustion air stream can take place by way of control of the adjustment device, and thereby a change in the temperature of the flame 6 is brought about, which in turn brings about a change in the actual NOX value.

In the exemplary embodiment according to FIG. 2, the infrared radiant heater is configured as a bright radiant heater and comprises a burner 6 that is connected to a hydrogen supply 7 and a fan 8. A reflector 9 is arranged to enclose the burner 6.

The burner 6 comprises a fuel mixing chamber 61, which is delimited by a ceramic radiant panel 62. The ceramic radiant panel 62 is provided, in a known manner, with a hole pattern that extends over the entire surface, formed by cylindrical flame passage channels, which are configured to widen conically on the side of the radiant panel 62 that is directed outward. Lying opposite the radiant panel 62, a hydrogen supply 7 is arranged orthogonal to the panel, which supply opens into the fuel mixing chamber 61. At a right angle to the hydrogen supply 7, a pressure line 81 opens into the fuel mixing chamber 61, which line is connected to the fan 8.

On the suction side, the fan 8 is connected to a combustion air supply 82, wherein an ejector 83 is inserted into the pressure line 81, within the reflector 4, by means of which ejector a suction gap 84 that radially encompasses the pressure line 81 is formed. The section of the pressure line 81 that follows the ejector 83 forms a combustion air mixing space 86. The combustion air stream drawn in by the fan 8, by means of the combustion air supply 82, serves as a driving medium here, by means of which suctioning in of part of the exhaust gas cushion 851 situated within the reflector 9, through the suction gap 84, is brought about. The remaining exhaust gas stream 85 flows out of the reflector 9 into the ambient air. The width of the suction gap 84 can be set by way of an adjustment device present in the ejector 83, and thereby, in turn, the proportion of the exhaust gas stream 85 in the exhaust gas/combustion air stream mixture and thereby its oxygen content can be set.

The exhaust gas/combustion air mixture that exits from the combustion air mixing space 86 of the pressure line 81 is mixed with the hydrogen stream introduced by means of the hydrogen supply 7, and, once again, after exiting through the radiant panel 82, ignited by means of the ignition electrode 63 arranged on the burner 6, on the outside, in front of the radiant panel 62.

A sensor holder 91 is affixed in the reflector 9, which holder has a window 92. A UV sensor 5 is introduced into the sensor holder, which sensor is connected to a setting device 32 for interrupting the hydrogen supply, by way of an electrical line 51. In the exemplary embodiment, the UV sensor 5 is oriented at an angle of 45° relative to the radiant panel 62. If no flame is detected by the UV sensor 5, then the hydrogen supply is interrupted by the setting device 32, a setting valve in the present case. The setting device 32 or the control and regulation module 33 connected to it can be additionally connected, here too, to the ignition electrode 63, and set up in such a manner that in the event that no flame is detected, first the ignition electrode 63 is activated, and only after there continues to be no flame, interruption of the hydrogen supply takes place.

In this exemplary embodiment, as well, a UV sensor 5 can be used that is set up for NOX measurement by means of UV resonance absorption spectroscopy and connected to a control and regulation module that is connected to the setting device 32 for interrupting the hydrogen stream and/or the combustion air stream, wherein the control and regulation module 33 is programmed in accordance with the above explanations relating to the dark radiant heater. In addition, the programming can undertake regulation of the flame properties by way of adjusting the ratio of exhaust gas stream and combustion air stream, by way of the adjustment device of the ejector 83. For this purpose, the adjustment device is connected to the control and regulation module 33.

The invention claimed is:

1. An infrared radiant heater, having a burner and a fan,
wherein the burner is connected to a fuel gas supply,
wherein the fan is set up for supplying combustion air to the burner,
wherein the fuel gas supply is connected to a hydrogen source as the fuel gas source,
wherein a UV sensor is provided that is set up for detecting at least one parameter of a flame produced by the burner, wherein the infrared radiant heater is a bright radiant heater that has a radiant panel provided with flame passage channels, which serves as a radiating surface, wherein the burner is set up to bring about glowing of the radiant panel over a full area of the radiant panel, and wherein the UV sensor is directed at the radiant panel.

2. The infrared radiant heater according to claim 1, wherein a reflector that encloses the radiant panel, at least in certain regions, is provided, which is provided with a viewing window, wherein the UV sensor is directed at the radiant panel from outside of the reflector and the UV sensor is configured to emit an electromagnetic wave through the viewing window.

3. The infrared radiant heater according to claim 2, wherein the reflector encloses the radiating surface of the radiant panel and delimits an exhaust gas space, wherein a combustion air mixing space is arranged ahead of the burner and is connected to a combustion air source and the exhaust gas space.

4. The infrared radiant heater according to claim 3, wherein the exhaust gas space is connected to the combustion air mixing space by way of an ejector, wherein the driving medium of the ejector is the combustion air introduced by means of the fan, and the medium drawn into the combustion air mixing space is exhaust gas situated in the exhaust gas space.

5. The infrared radiant heater according to claim 4, wherein an adjustment device is provided, by way of which the ratio of the combustion air volume stream to the exhaust gas volume stream of the ejector that is drawn in can be set.

6. The infrared radiant heater according to claim 1, wherein the UV sensor is connected to a setting device connected to the fuel gas supply, for interrupting and/or setting the hydrogen supply.

7. The infrared radiant heater according to claim 1, wherein the UV sensor is set up for NOX measurement.

8. The infrared radiant heater according to claim 1, wherein a setting device and/or an adjustment device is connected to a control and regulation module that is programmed to regulate the flame properties by means of a comparison of an actual parameter transmitted by the UV sensor with a stored reference parameter, by means of changing the hydrogen volume stream and/or the combustion air volume stream and/or the ratio of exhaust gas stream and combustion air stream.

9. The infrared radiant heater according to claim 8, wherein the actual parameter is a NOX value detected by the UV sensor, wherein the control and regulation module is programmed to regulate the flame temperature on the basis of the difference between an actual value and a stored reference value, by means of changing the hydrogen stream and/or the combustion air stream and/or the ratio of exhaust gas stream and combustion air stream.

10. The infrared radiant heater according to claim 1, wherein the UV sensor is set up for NOX measurement using UV resonance absorption spectroscopy.

* * * * *